United States Patent [19]

Kaneda et al.

[11] 4,397,449

[45] Aug. 9, 1983

[54] APPARATUS FOR COOLING HOT-ROLLED WIRE RODS

[75] Inventors: Hiroshi Kaneda; Hiroshi Sato; Katsunori Nashimoto; Tadashi Matsui, all of Kamaichi, Japan

[73] Assignee: Nippon Steel Corporation, Tokyo, Japan

[21] Appl. No.: 362,841

[22] Filed: Mar. 29, 1982

Related U.S. Application Data

[63] Continuation-in-part of Ser. No. 186,009, Sep. 10, 1980, abandoned.

[30] Foreign Application Priority Data

| | | | |
|---|---|---|---|
| Sep. 13, 1979 | [JP] | Japan | 54-116678 |
| Dec. 14, 1979 | [JP] | Japan | 54-161619 |
| Dec. 14, 1979 | [JP] | Japan | 54-161620 |
| Dec. 14, 1979 | [JP] | Japan | 54-161621 |
| Dec. 14, 1979 | [JP] | Japan | 54-172267[U] |
| Dec. 24, 1979 | [JP] | Japan | 54-166907 |
| Dec. 29, 1979 | [JP] | Japan | 54-172124 |
| Dec. 29, 1979 | [JP] | Japan | 54-172125 |
| Dec. 29, 1979 | [JP] | Japan | 54-181943[U] |
| Dec. 29, 1979 | [JP] | Japan | 54-181944[U] |
| Feb. 1, 1980 | [JP] | Japan | 55-10030 |

[51] Int. Cl.[3] ..... C11D 9/64

[52] U.S. Cl. ..... 266/106; 148/156

[58] Field of Search ..... 266/106, 111–113; 148/153, 155, 156

[56] References Cited

U.S. PATENT DOCUMENTS

| | | | |
|---|---|---|---|
| 3,711,918 | 1/1973 | Shore | 266/106 |
| 3,832,788 | 9/1974 | Kato et al. | 266/106 |
| 4,054,276 | 10/1977 | Wilson | 266/106 |
| 4,090,697 | 5/1978 | Perrine | 266/106 |

*Primary Examiner*—L. Dewayne Rutledge
*Assistant Examiner*—Christopher W. Biody
*Attorney, Agent, or Firm*—Wenderoth, Lind & Ponack

[57] ABSTRACT

An apparatus for cooling a rod delivered successively from a hot rolling mill while transferring it. The apparatus has a laying reel for forming the rod into successive rings, and a conveyor having a coil receiving portion for receiving the rings and forming them into a densely packed coil having a plurality of overlapped rings with the centers of the rings offset in a transferring direction. The conveyor has at least one step for loosening the coil when it is conveyed over the step. An enclosure is provided for enclosing. The sections of the conveyor between which the step is located. The enclosure has stirring devices for keeping the gaseous heat transfer medium within the enclosure at substantially uniform temperatures, which progressively decrease in the direction of movement of the conveyor. A plurality of coolant nozzles are provided at the step for blowing coolant on to the back of the vertically dropping rings.

10 Claims, 32 Drawing Figures

APPARATUS FOR COOLING HOT-ROLLED WIRE RODS

This application is a continuation-in-part of application Ser. No. 06/1186,009, filed Sept. 10, 1980, now abandoned.

This invention relates to an apparatus for cooling hot-rolled wire rods. More particularly, it relates to a cooling apparatus that efficiently provides uniform in-line cooling of the entire length of the rod delivered successively from the hot-rolling process.

BACKGROUND OF THE INVENTION AND PRIOR ART

Carbon steel rods for constructing machines under severe conditions, alloy steel rods containing such special elements as Ni, Cr and Mo, and spring steel rods, etc. are normally subjected to various heat treatments before or during subsequent processing to end products. This invention relates to an apparatus for manufacturing softened wire rods from a hot rod mill with a view of eliminating one of the heat treatments, e.g. annealing and normalizing.

It is well-known to form the hot-rolled rod into non-concentrically overlapped rings and deposit it in this form onto a conveyor, and then rapidly cool the rings by forced air so they move to the delivery end of the conveyor where they are gathered into a bundle. This conventional rapid cooling is used for plain carbon steel rods containing low, medium and high carbon content, which are drawn and fabricated into end products without requiring further heat treatments. But this method is inapplicable to some alloy and carbon steels, especially for cold heading, which do not attain the desired quality unless they are cooled more slowly during allotropic transformation. The softening of high-grade steel rods especially calls for much slower and strictly controlled cooling. The targeted quality level cannot be attained unless such steels are cooled along a predetermined cooling curve.

U.S. Pat. No. 3,930,900 discloses an inline rod cooling method and apparatus. According to this publication, a laying head delivers hot-rolled rod in overlapped non-concentric rings onto a conveyor. In order to cool the traveling rod rings uniformly, this publication employs a combination of the following three steps: (1) sending varying intensities of radiant heat in an amount substantially inversely proportional to the distribution of accumulated rod mass in the cross-section of the overlapped rings of the coiled rod per unit width of the conveyor to different parts of the rings across the width of the conveyor; (2) causing radiant energy to emanate from the portions of the coiled rings on both sides of the conveyor and restraining the emanation of heat from the middle thereof substantially according to the distribution of accumulated rod mass in the cross-section of the coil; and (3) minimizing the cooling of the rod due to convection by conveying the rings in an enclosed space with a controlled environment. The cooling apparatus for implementing this method comprises the combination of: a conveyor for forwarding the overlapped rings; a cooling chamber substantially covering the conveyor and the rings traveling thereon, the inside walls of the cooling chamber reflecting the radiant heat from the rings, and having a fixed base and a selectively movable top cover, an adjustable opening being provided in the side wall of the cooling chamber; and a radiation controller provided inside the cooling chamber facing the conveyor and spaced therefrom and having a plurality of radiating surfaces which are individually maintained at an independently pre-selected temperature by a plurality of independent temperature controllers. The object of this prior art system is to provide accurately controlled slow cooling along the entire length and also across the cross-section of the coils of the rod, which easily permits conversion to rapid cooling and cooling rate adjustment within the 0° C./sec. to 20 C./sec. range.

As can be understood, the technique disclosed in the United States patent publication accomplishes cooling rate adjustment by selectively controlling not convection but radiation. In more concrete terms, this prior art technique takes into account the distribution of the rod mass per unit width of the conveyor on which the offset rings are laid. The technique comprises either applying radiant heat to the rod rings in substantially inverse proportion to the mass distribution, or causing radiant energy to emanate and restraining the emanation substantially according to the mass distribution. The rod mass in the cross-section is maximal at both sides of the conveyor where the rings overlap each other and minimal at the center of the conveyor where the rings are separate from each other. Accordingly, the rings release more of their heat at the center of the conveyor than at both sides. Therefore, if the rings are allowed to release heat naturally, i.e. without any regulating means the portions of the rings at the center of the conveyor cool off faster than the portions at the sides of the conveyor. The prior art publication considers that the desired effect can be obtained because irregular cooling of the rings is avoided by the control of radiation rates at different parts of the rings.

But studies and experiments made by the inventors have shown that the understanding of those in the prior art is not altogether correct. Rather, the method of the prior art has proved to be incapable of completely eliminating the irregular cooling at different parts of the rings. Controlled cooling according to the prior art has also proved ineffective, particularly in obtaining the desired mechanical properties for high-grade steel rods which meet difficulty in softening.

In their studies, the inventors measured the temperatures at different points, as indicated by the symbols in FIG. 1, on the outer surface area and the center area of the cross-section of the coil of overlapped rings of the coiled rod traveling along a roller conveyor in a cooling chamber enclosing the coiled rod and roller conveyor for controlling the environment. The temperatures at the different points were measured at several points along the conveyor, i.e. after different holding times. The results obtained are shown in FIG. 2. For the purpose of making these measurements, the coiled rod was heated to a temperature substantially equivalent to that at which the hot-rolled rod is actually delivered from the laying reel, and the temperature of the atmosphere in the upper part of the cooling chamber was kept at 650° C. to impede convection heat loss from the coiled rod. As is evident from FIG. 2, the temperature profile across the width W of the cross-section of coiled rings is higher at the two edges than at the center, and the difference is in proportion to the distribution of the rod mass. Overall, the temperature is highest at the middle of the vertical dimension of the two edges of the cross-section where the rod mass (or density) is great and lowest at the bottom where the rings in the cross-section contact the roller conveyor. That is, the greatest temperature difference, exceeding 100° C., exists between the core (center) and bottom of the two edge portions of the cross-section where the rod mass concentration is maximal. Presumably, this is due to the fact that the core portions of the two edges of the cross-section are held at high temperatures by the heat carried by the rod from the preceding hot-rolling process, the least amount of heat being released from these portions due to the heaviest rod mass concentration. Meanwhile, the bottom surface portion of the cross-section contacts the rollers of the conveyor. To prevent thermal wear, the bearing units of each roller are provided outside the cooling chamber, so that the bottom surfaces of edges of the cross-section located close to the bearing unit are cooled the most, releasing the greatest amount of heat by heat conduction through table rollers.

As will be understood, applying radiant heat in inverse proportion to the rod mass distribution across the width W of the cross-section or causing release of radiant energy from the two edges of the cross-section according to the rod mass concentration and restraining the release of heat from the middle portion, as proposed in U.S. Pat. No. 3,930,900 will not eliminate the temperature difference between the core portions of the two edge portions and the bottom surfaces of the cross-section and, therefore, as a result, will cause the non-uniform cooling. In practice the prior art method actually accelerates the supercooling of the bottom surfaces of the cross-section.

When the hot-rolled rod is transferred onto a conveyor, the coil still retains a considerable amount of heat which can be effectively utilized for softening in the cooling chamber, permitting considerable energy saving. But the cooling chamber according to the above-described prior art does not make effective use of the heat retained by the rod, but rather supplies radiant heat from a radiant tube (or a radiant heat controller) provided therein.

From the foregoing and from the results of various experiments, the inventors have found the following:

(1) From the viewpoint of equipment layout and investment cost, it is advantageous to perform in-line slow cooling of the hot-rolled rod in the shortest possible time and on the shortest possible line. It is therefore desirable to pack the coiled rings on the conveyor as densely as possible.

(2) It is necessary to carry out controlled cooling to minimize the temperature difference among the different parts of the cross-section being slow-cooled and thereby cool the entire coil uniformly.

(3) To achieve energy saving, the heat carried over from the hot rolling process must be effectively utilized for the slow-cooling.

(4) To make it possible to use a limited treating time and line length, steels that are difficult to soften must be cooled in a highly efficient manner using close temperature control to cool them according to a preestablished cooling curve.

(5) It is desirable that cooling equipment be capable of performing not only the above-described slow-cooling but also conventional forced-air cooling properly and rapidly so as to be usable for a variety of steels.

In conventional forced-air cooling, the rod is cooled rapidly. This rapid cooling following the rolling produces uniform, fine pearlitic structures in high-carbon steel rods, imparting good drawability. In rods of plain carbon and alloy steels for machine structural use, however, the formation of fine pearlite by rapid cooling is not altogether desirable for subsequent processing. In order to give these steels a perfect ferrite-pearlite structure and soften them to the desired degree, they must, on the contrary be cooled slowly at a rate of not higher than approximately 0.2° C./sec.

OBJECTS AND BRIEF SUMMARY OF THE INVENTION

An object of this invention is to provide an apparatus for cooling hot-rolled steel rods that carries out precise, uniform slow-cooling of the entire length of the coiled rod according to a preselected cooling curve.

Another object of this invention is to provide an apparatus for cooling hot-rolled steel rods that softens the mechanical properties to the desired level even in grades of steel that have been difficult to soften by a conventional apparatus.

Still another object of this invention is to provide an apparatus for cooling hot-rolled steel rods that eliminates the temperature difference between the core and bottom surface of the cross-section of the coiled rod, which difference has been difficult to attain by conventional apparatus.

Yet another object of this invention is to provide an apparatus for cooling hot-rolled steel rods that permits cooling the rod on a greatly shortened line.

A further object of this invention is to provide an apparatus for cooling hot-rolled steel rods that permits effectively implementing the aforementioned slow-cooling as well as readily switching, when required, to rapid forced-air cooling.

A still further object of this invention is to provide an apparatus for cooling hot-rolled steel rods that cools the rod while retaining, rather than releasing, the heat carried over from the hot-rolling process, thereby achieving considerable energy saving.

In the apparatus of this invention, the hot-rolled rod is placed, in densely packed coil form, on a conveyor. This dense coil travels slowly in a controlled closed environment within a heat-retaining cover means. By causing the heat convection inside the enclosed environment, the heat retained by the rod keeps the surface temperature of the cross-section at a substantially uniform level. The densely packed rings are loosened one or more times by being passed over a step which produces a vertical drop sufficient to cause the preceded rings to make an opening between them and the succeeding rings, and the succeeding rings to again come in contact with the preceding rings with substantially no rubbing therebetween. A coolant is blown onto the loosened rings to accelerate the removal of heat from the high-temperature portion of the rod rings, i.e. that near the cores of the densely packed rings at both edges of the cross-section, thus reducing the temperature difference among different parts of the pile of rings. If necessary, heat is supplied to the low-temperature portion at the bottom surface of the cross-section where they contact the conveyor.

The apparatus according to this invention not only makes it possible to carry out precise, uniform slow cooling of the densely packed coil, but also to adequately soften rods of grades of steel which have been difficult to soften by the conventional apparatus. Effective utilization of the heat carried over from the rolling process is advantageous for energy saving. The releasing of heat from the core parts at both edges of the cross-section permits uniform cooling, which has heretofore been impossible, equalizing the cooling rate at the surface and core of the densely packed coil.

According to this invention, the rod in the densely packed coil is cooled while making the conveyor speed much slower than conventional idea thereof. This permits performing slow cooling in a short distance and, therefore, shortening the equipment length.

All these effects result from loosening the densely packed coil, which is carried out one or more times, and blowing of a coolant onto the loosened rings in the ambient temperature uniformly maintained inside the heat-retaining cover. By being able to operate in this way, the apparatus according to this invention produces remarkably new and useful results.

Furthermore, the apparatus according to this invention can be furnished with both a forced-air cooling unit and a slow cooling unit, which operate at entirely different cooling rates, and the apparatus can be shifted so as to use one or the other on the same line.

DETAILED DESCRIPTION OF THE PREFERRED EMBODIMENTS

Figure 3A:
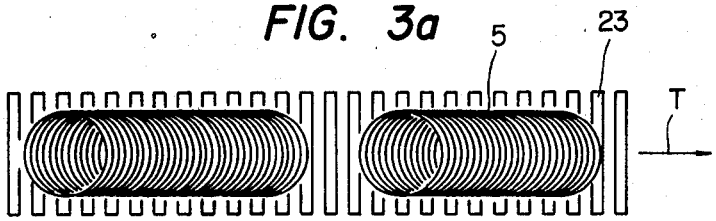
FIGS. 3*a* and 3*b* are plan views of a densely and loosely packed coiled rod on a conveyor, respectively.

In the apparatus of the invention, a hot-rolled rod is laid in a densely packed coil on a conveyor. The densely packed coil is slowly cooled while traveling through an enclosed chamber with a controlled environment. The densely packed coil is a coil formed by rings of the rod which are spirally laid in a so-called Spencerian type spiral by a laying head on a conveyor connected directly to a laying head, in a flat but slightly offset, overlapped configuration. FIG. 3*a* shows densely packed coils 5 formed on a roller conveyor 23. The densely packed coils 5 each consist of a number of continuous rings which are deposited onto the conveyor 23 so that adjacent rings are slightly offset from each other in the direction of travel of the conveyor and when viewed in cross-section, are densely packed. When falling into the conveyor 23, the rings are also slightly offset in the direction perpendicular to that of the travel. For the purpose of this invention, a densely packed coil means one having a weight between 30 and 550 kg per meter of conveyor length. More preferable coil weights are between 100 and 500 kg/m when the coil is to be cooled at a rate of not higher than 0.05°–0.2° C./sec., and between 30 and 70 kg/m when the cooling rate is to be between more than 0.2° C. and 1.0° C./sec. The transfer density (or coil thickness) of the densely packed coil depends solely on the relationship between the reeling speed and the conveyor speed. If the transfer density is too great, the coil becomes too overpacked to permit easy loosening during transfer along the conveyor, lessening the temperature difference reducing effect of the prior art method as discussed in connection with FIG.

2. Too small a transfer density, on the other hand, not only brings about a disadvantage in equipment layout and investment cost, but also prevents effective utilization of the heat retained by the coil. Accordingly, the densely packed coil of this invention is, as determined on the basis of examples described later, one that is coiled at such a rate as to attain a weight of 30 to 550 kg per meter of conveyor length, as distinct from the conventional coils.

Figure 4:
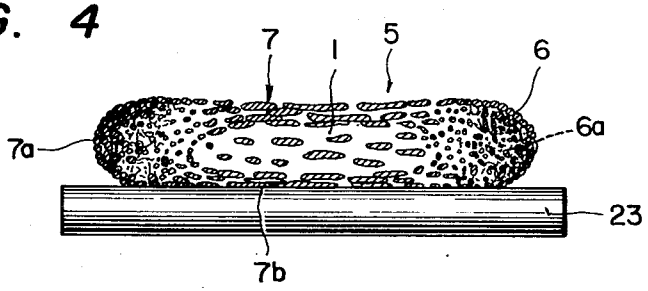
FIG. 4 is a vertical cross-section of the rings of a densely packed coil.

FIG. 4 is a cross section of the densely packed coil 5 taken perpendicular to the direction of transfer T, with the cross-section of rod 1 indicated by the hatching. As can be seen, the rings of the coiled rod 1 are in what appears to be a pile of rings, the rings being very densely packed together at both edges 6 of the cross-section.

The external surface 7 of the densely packed coil 5 comprises external surfaces of the individual rings extending between the two edges, including those on the bottom *7b*, and those on the outside *7a* of the edges 6. More concisely, the external surface 7 corresponds to those parts which are indicated by the open and solid symbols in FIG. 1.

Figure 1:
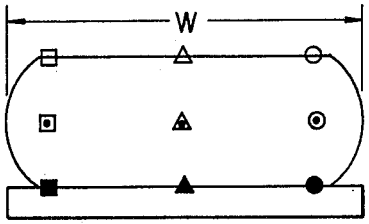
FIG. 1 is schematic cross-section of a densely packed overlapped rings of a coiled rod, the cross-section being taken perpendicular to the longitudinal axis of the coil, and indicating points at which temperature measurements were taken.

The cores *6a* of the dense edges 6 are where the rod density is heaviest, such as indicated by the dotted square and dotted circle in FIG. 1.

The rod in densely packed coil form passes through an enclosed space having a controlled environment. The controlled environment, as used here, means an environment within a heat-retaining cover or chamber equipped with a device that is capable of cooling the densely packed coil according to an optimum cooling curve. Because it makes positive use of convection, the controlled environment according to this invention differs from such non-conventional environments as are disclosed in U.S. Pat. No. 3,930,900, described hereinbefore and U.S. Pat. No. 3,940,961.

Furthermore, the controlled environment of this invention differs from the conventional environments in that it has means to decrease the temperature difference among different parts of the rings constituting the coil 5 by maintaining the temperature at the external surfaces 7, *7a* and *7b* at a substantially uniform level and, at the same time, accelerating the releasing of heat from the cores *6a* of the densely packed parts of each edge 6 of the cross-section of the coil 5.

While the densely packed coil 5 passes through the controlled environment, the temperature at the external surfaces 7, *7a* and *7b* is kept uniform. For this purpose, the atmosphere in the enclosed environment is stirred to make the ambient temperature uniform in the vicinity of the densely packed coil. Also, temperature compensation may be achieved by locally heating the external surfaces *7a* and/or *7b* at both edges and on the bottom of the cross-section of the densely packed coil 5, e.g. by use of an electric heater.

While passing through the controlled environment, the densely packed coil 5 is loosened so as to expedite the release of heat from the cores *6a* of the densely packed parts at both edges *6a* of the cross-section thereof. An appropriate method to loosen the densely packed coil 5 is to provide a step midway in the conveyor so that the rings making up the densely packed coil are vertically expanded when descending the step and are thereby loosened.

The densely packed coil 5 is loosened by relative movement of the rings vertically by the provision of a step in the conveyor. By a step is meant structure providing a free vertical drop sufficiently high for loosening the densely packed coil by making an opening between the preceding rings and the succeeding rings, and causing the succeeding rings to again come in contact with the preceding rings. Because the drop is a free vertical drop, there is substantially no rubbing between the rings of the coil, thereby substantially completely avoiding scratch-like imperfections in the surfaces of the rings, which gives the finished product good drawing properties.

This loosening separates the overlapped rings from each other, temporarily loosening the densely packed parts. The atmosphere of the controlled environment then flows freely through the thus loosened parts to accelerate the release of heat therefrom.

The release of heat from the loosened densely packed edges 6 can be accelerated by applying a coolant thereto. The coolant can be a fluid that can be used in an industrial system, such as air, an inert gas, a mist-containing gas, and steam. The most preferable coolant is the gas forming the atmosphere of the controlled environment through which the densely packed coil is being passed. The atmospheric gas, either as it is or after temperature adjustment, is blown through a nozzle against the rings making up the densely packed coil, the nozzle being directed toward the cores *6a* of the densely packed edges 6. The temperature of the coolant need not be limited to any specific temperature other than that it be lower than the temperature of the densely packed edges 6.

In slow-cooling the rod according to this invention, the optimum cooling pattern is selected based on the steel quality set forth by the specifications of the Japanese Industrial Standards (JIS). The cooling pattern recommended by the inventors comprises passing the rod in succession through a stage where the hot-rolled rod from the finishing stand is cooled from the finishing temperature to a reeling temperature in a water cooling zone, a stage where the densely packed coil 5 formed on and carried on the conveyor is cooled, a stage where the entire densely packed coil 5 is slowly cooled at a rate not higher than 0.05° C. to 1.0° C./sec. to a temperature between the temperature at which pearlitic transformation is completed and a temperature 50° C. therebelow during the time the coil on the conveyor passes through the controlled environment, and a stage where the slowly cooled coil 5 is cooled by forced-air while the coil density is reduced by increasing the speed of the latter part of the stepped conveyor.

By carrying out this cooling pattern under the conditions specified in the claims attached hereto, quality steels such as JIS S45C, SCM435 and SUP6 having tensile strengths as given below, can be obtained.

| Steel Type (JIS) | Tensile Strength |
|---|---|
| S45C | ≦68 kg/mm$^2$ |
| SCM435 | ≦80 kg/mm$^2$ |
| SUP6 | ≦100 kg/mm$^2$ |

Figure 2:
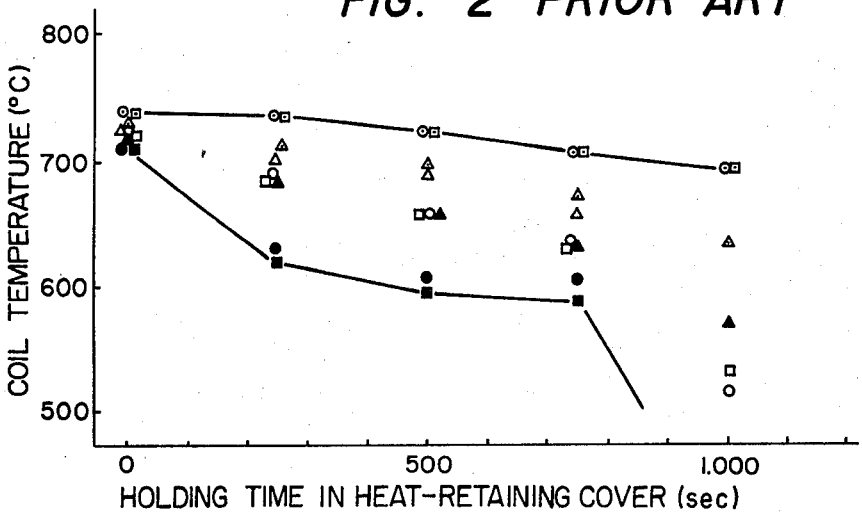
FIG. 2 PRIOR ART
FIG. 2 is a diagram showing temperatures measured at the points shown in FIG. 1 during slow cooling according to a prior art method.

This is achieved by greatly reducing the temperature differences in the densely packed coil 5 from those as shown in FIG. 2.

Specific embodiments of this invention will now be described in detail with reference to the accompanying drawings.

FIRST EMBODIMENT

Figure 5:
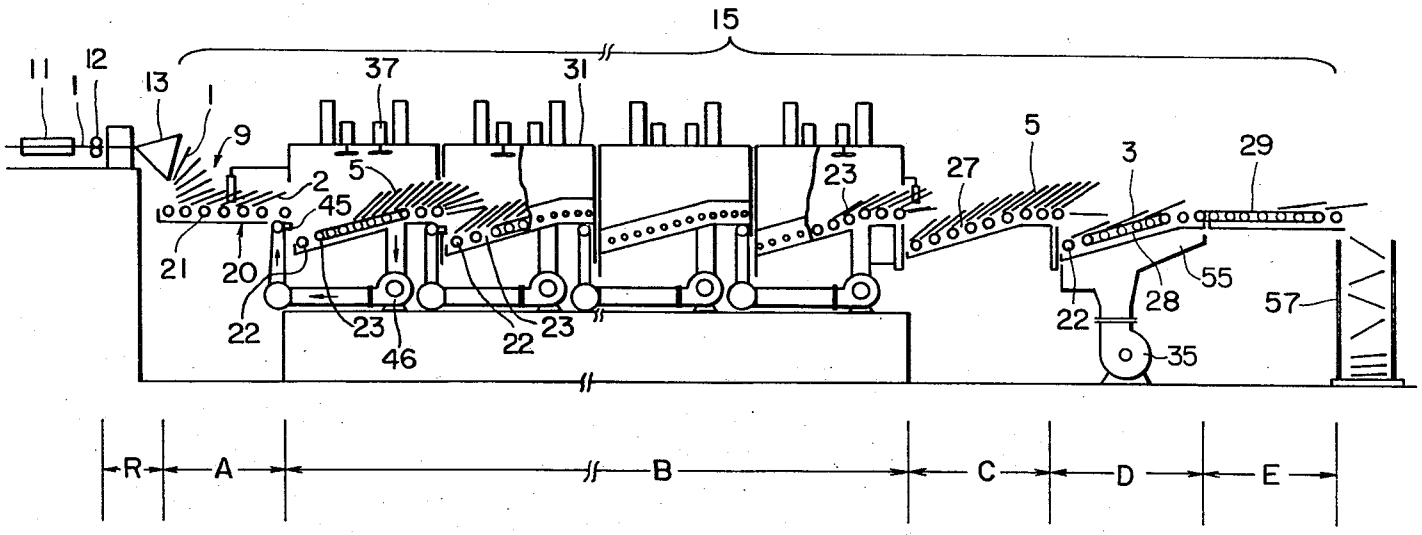
FIG. 5 is a schematic illustration of a rod mill incorporating a cooling apparatus according to this invention.

FIG. 5 shows a line in which a cooling apparatus 15 according to this invention is installed subsequent to a water-cooling nozzle 11, pinch rolls 12 and laying reel 13 which receive rolled rod 1 from a hot rod mill (not shown).

A transfer conveyor, indicated generally at 20, is provided between the laying reel 13 and the reforming tub 57 to convey coils of the rod. The rod is continuously cooled on the conveyor 20 according to a desired cooling curve. According to this invention, the path along which the conveyor 20 moves the coils is divided into a relatively short zone A at the laying reel end where the rod falling from the laying reel 13 is formed into a coil 9 of offset rings somewhat less densely packed than when slow cooling is being carried out, a relatively long heat-retaining zone B next following the zone A, with a step 22 between zones A and B, and with zone B being enclosed by a heat-retaining cover 31 and in which the densely packed coil 5 is slowly cooled while traveling, a natural cooling zone C next following the heat-retaining zone B to naturally cool the densely packed coil 5, a rapid cooling zone D next following the natural cooling zone C and wherein the coil is made less densely packed as at 3 and is rapidly cooled, and an approach zone E where preparation for reforming is made. What is essential to the invention is what is between zone A and the rapid cooling zone D.

Preferably, the transfer conveyor 20 is a roller conveyor. The conveyor speed is lowest in the heat-retaining zone B and the natural cooling zone C, and faster in the zone A and the rapid cooling zone D. This increases the time during which the densely packed coil stays in the heat-retaining zone B and the natural cooling zone C, thereby making it possible to provide adequate softening of the steel of the rods by the use of a compact line.

When the rod is of a steel that can be softened without much slow cooling, the individual zones of the conveyor can be operated at equal speed.

As shown, a coil receiving section 21 of the conveyor which carries the coiled rod 1 the rings of which fall thereon, is disposed directly below the laying reel 13.

Figure 3B:
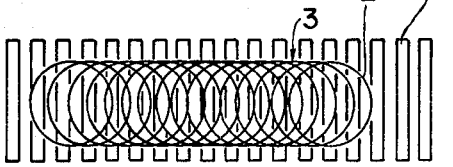

The hot rod 1 from the laying reel is supplied to the open zone A, rather than directly to the heat-retaining zone B, in order to provide a space in which any rise of the tail end of the rod (which occurs frequently when the reeling temperature is not higher than 800° C.) and reeling troubles can be dealt with, as well as providing good visibility from the pulpit, and to shorten the rolling intervals. Since the zone A is not convered with the heat-retaining cover, the surfaces 7 of the densely packed coil will be cooled faster especially at the sides 7*a* and the bottom 7*b* of the cross-section than the core 6*a* of the densely packed part, thereby increasing the temperature differences in the coil. It is therefore desirable to convey the coil in a less densely packed or somewhat spread out condition, thereby decreasing the temperature difference within the cross-section of the coil as much as possible. In order to coil the rod into the preferred offset coil form on the coil receiving section 21 of the conveyor directly below the laying reel, the conveyor speed, which is closely related to the reeling speed, must be above a certain level (usually not lower than approximately 6 m/min.). This can be achieved by conveying the rod 1 in a less densely coiled form, such as shown at 3 in FIG. 3*b*, which is obtained by increasing the conveyor speed in the zone A, then forming the coil into the desired densely packed form by making use of a step 22 provided between the zone A and the heat-retaining zone B and slowing down the conveyor speed in the heat-retaining zone B relative to that in zone A. To meet these requirements an appropriate length of the zone A is approximately 4 m.

Alternatively, the densely packed coil 5 may be formed directly on the rollers of the coil receiving section 21 at the delivery end of the laying reel 13. The densely packed coil 5 having the desired weight per unit length (between 30 and 550 kg/m) can be formed on the section 21 by driving the rollers thereof at a preselected suitable speed.

What is herein called a less densely packed or more spread out coil is a coil having a ring density less than that of the densely packed coil 5. In other words, adjacent rings are separated from each other by a greater amount in the direction of coil travel in a spread out coil 3 than in the densely packed coil 5.

In the heat-retaining zone B, the densely packed coil 5 is conveyed at a low speed and is subjected to slow cooling for accomplishing softening by ferritic and pearlitic transformation. The cooling rate in the heat-retaining zone B must be controlled stepwise and precisely. Further, the entire cross-section of the densely packed coil 5 must be cooled uniformly. To obtain steel rod of the desired quality, the temperature at which slow cooling is started and the cooling rate are set. After the cooling time and travel speed are determined, the length of the heat-retaining zone B is decided. The shorter the length of the heat-retaining zone B, the more advantageous from the viewpoint of equipment cost. Therefore, a rod requiring a longer cooling time must be conveyed at a slower speed, and vice versa.

In the heat-retaining zone B, the edges 6 of the densely packed coil 5 are at the highest temperature, as described before. It is therefore difficult to cool the entire coil uniformly unless heat is released from these parts. This heat release from the edges 6 in the heat-retaining zone B is achieved by dropping, and thereby loosening, the densely packed coil 5 at steps 22 provided along the conveyor at regular intervals. A plurality of such loosening steps 22 is provided, e.g. six in the heat-retaining zone of the embodiment being described, and at each loosening step the temperature of the edges 6 is lowered by approximately 10° C.

In order to carry out the step-by-step slow cooling of the densely packed coil 5, the heat retaining zone B is sub-divided into a plurality of sections. The embodiment illustrated has six sections corresponding to the number of steps 22. To loosen the coil adequately, each step 22 in the conveyor 20 must be approximately 200 to 400 mm high. The inclination of the inclinable section 23 of the conveyor between adjacent steps should not be greater than 5 degrees. The coil may slip backwards down the section 23 of the conveyor if the inclination is steeper, and conversely, if the inclination is too small, the length of the section of the conveyor necessary to form the next step becomes excessive. The number of times the coil must be loosened can be determined from the temperature drop which can be accomplished in each loosening and the ultimate target temperature.

In the embodiment illustrated, the sections 23 are movable for adjusting the inclination. But the sections 23 can be fixed, in which case the height of the steps is fixed.

The inclination of the conveyor sections 23 of the illustrated embodiment is adjustable for varying the height of the steps 22. This feature permits adjustment of the height of the steps to vary the amount of cooling at each step, and coil removal on an emergency basis in case of trouble.

The environment along the sections 23 is controlled by covering them with heat-retaining covers 31 that enclose the respective sections 23 and the densely packed coil 5 being conveyed thereon.

Figure 6:
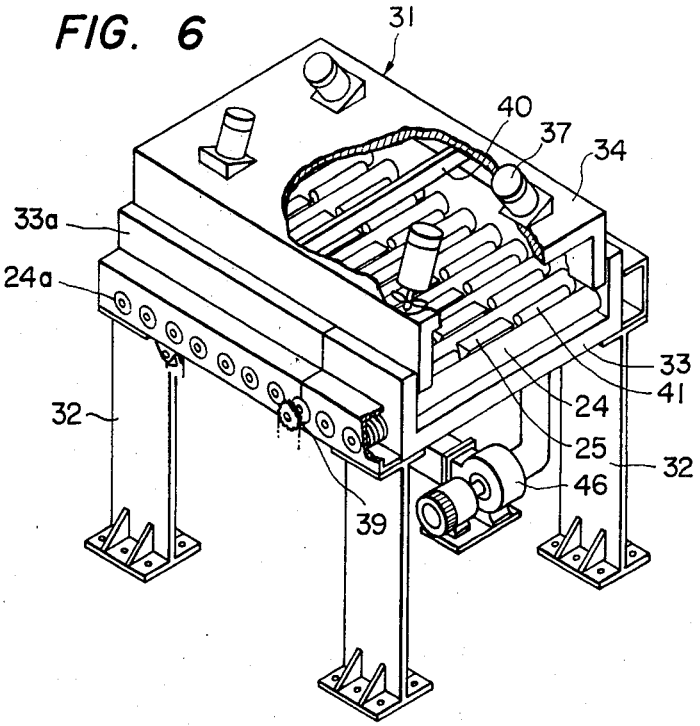
FIG. 6 is a perspective view showing details of a heat-retaining cover of the apparatus of FIG. 5.
Figure 7:
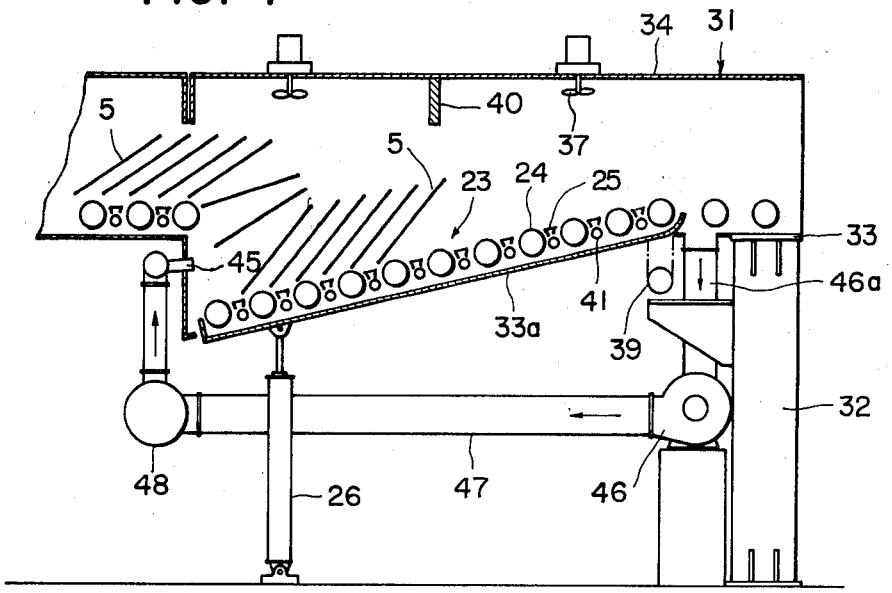
FIG. 7 is a sectional side elevation of the heat-retaining cover.

FIGS. 6 and 7 show details of a heat-retaining cover 31 for one section 23 of the conveyor. Held at the desired height by supports 32, the heat-retaining cover 31 comprises a horizontal bottom wall portion 33 mounted on the supports 32 and which has a channel-shaped cross-section and in which is mounted a plurality of rollers 24. Pivoted to wall portion 33 is a wall portion 33*a* also having rollers 24 therein, the portions 33 and 33*a* making up the roller conveyor section 23. A top cover 34 is fitted over the lower wall portions 33 and 33*a*. The top cover 34 is designed to be opened and closed freely by a crane or other suitable opening and closing device (not shown).

A plurality of fans 37 are attached to the inside of the top cover 34 for agitating or stirring the atmosphere within the cover 31 to maintain a substantially uniform temperature by convection.

A baffle 40 transverse to the direction of coil travel projects downwardly from the ceiling of the top cover 34. The atmosphere within the cover is stirred by the fans 37 and is directed downwardly by the baffle 40 for circulating within the cover 34. This prevents outside atmosphere from entering the heat-retaining cover 31 through the opening at the entrance and exit ends thereof.

It is preferable to provide an electric heater or other heating means on the side walls of the heat-retaining cover 31 for carrying out temperature compensation and preheating prior to the slow cooling operation.

As shown, the bearings 24*a* for each roller 24 in the roller conveyor section 23 are disposed outside the heat-retaining cover 31. One of the rollers 24 is connected to a roller drive 39, and the rest are connected thereto by a driving chain (not shown). The speed of the roller drive 39 can be changed to change the rotating speed of the rollers, thereby changing the speed of the coil 5 along the conveyor as desired.

The rollers 24 making up the roller conveyor section 23 are cooled to a temperature below the temperature of the atmosphere within the cover 31 as a result of release of heat from the bearings thereof placed outside the cover 31. Consequently, the portion of the cross-section of the coil 5 near the bottom 7*b*, and especially at the two edges thereof close to the bearings, is likely to be overcooled. It is therefore necessary to provide heat loss compensation means, such as an electric heater 41 between each pair of rollers 24, one on each side of the conveyor section, as shown in FIGS. 6 and 7, to heat the bottom portion of the coil. The electric heaters 41 need not be turned on at all times, but they are for providing temporary heat loss compensation when a temperature drop in the coil bottom 7*b* is detected.

A rod check plate 25 may be provided in the center of the width of the conveyor between each pair of rollers 24 to prevent the leading ring of the cooled rod falling over a step at the entry end of the conveyor section 23, from plunging into the space between the rollers.

Figure 8:
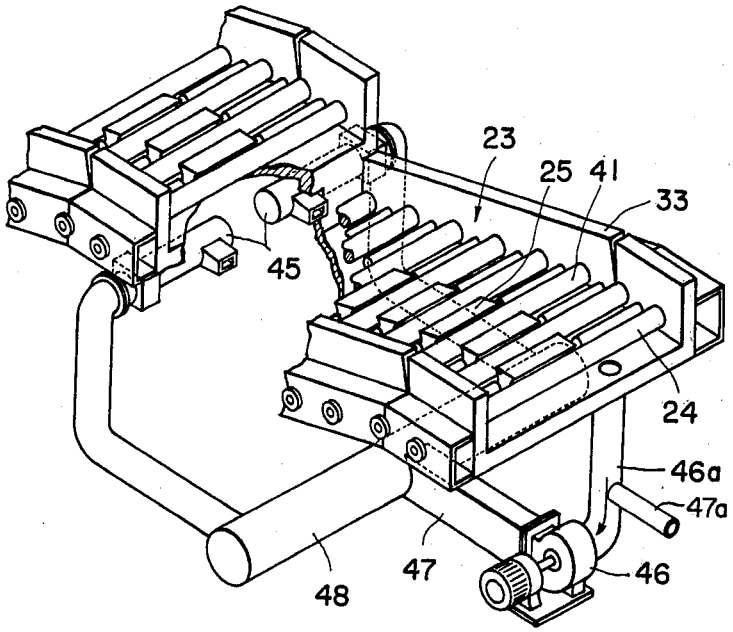
FIG. 8 is an enlarged perspective view, partly broken away, of an upper and lower roller table and a coolant blowing nozzle forming part of the apparatus shown in FIG. 5.

As shown in FIG. 7, a conveyor section elevating device 26 is connected to the lower end of the wall portion 33*a* near the entry end thereof to raise and lower that end of roller conveyor section 23. The lower wall portion 33*a* of the roller conveyor section 23 is lowered to provide a step for loosening the densely packed coil 5 being cooled thereon. The height of the step can be varied within the range of 200 to 400 mm, depending on the inclination of the section needed to prevent coil slippage and on the amount of cooling to be accomplished in the step. A pair of laterally spaced coolant nozzles 45, shown clearly in FIG. 8, is provided in the space between the end of the preceding roller conveyor section and the lowered end of the roller conveyor section 23. The nozzles 45 blow a coolant, e.g. gas constituted by the atmosphere within the heat-retaining cover 31 and the temperature of which has been adjusted to a level slightly lower than the coil temprature, against the cores 6*a* of the edges 6 of the loosened coil falling through the step.

The atmospheric gas within the heat-retaining cover is drawn into a suction port 46*a* provided at the delivery end of the roller conveyor section 23 by a circulating blower 46 which delivers it through a duct and a header 48 to the pair of nozzles 45. The manner in which the coolant is taken in and blown through the nozzles 45 is not limited to the one illustrated. The coolant nozzles 45 are directed so that the coolant strikes the edges 6 of the coil, thereby increasing the efficiency of the heat release from the cores 6*a* of the densely packed parts on the edges of the cross-section of the coil 5.

The heat-retaining cover 31 is made of a heat insulating material having a steel shell on the outside thereof. The number of heat-retaining covers 31 can be selected according to the quality of the rod, cooling conditions, equipment layout, and so on. The number of times the coil is loosened can be selected at will, irrespective of the number of heat-retaining covers.

The natural cooling zone C following the heat-retaining zone B is provided specifically for retarded-cooling of the dense part of the densely packed coil.

In the natural-cooling zone C, a conveyor 27 is provided which is open to the atmosphere, and the rod remains in the densely coiled form as it is cooled.

Figure 9:
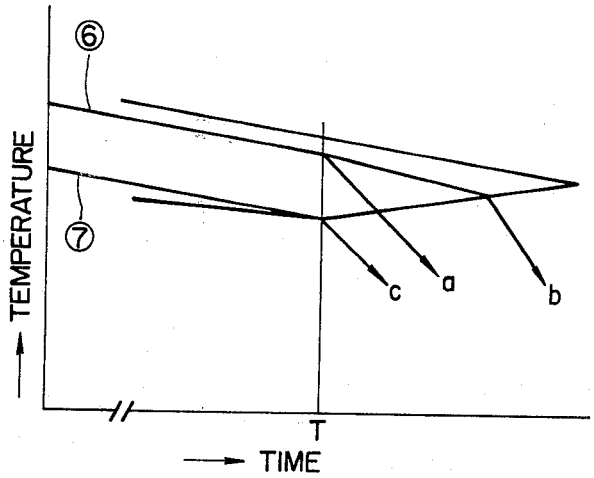
FIG. 9 is a diagram illustrating the temperature patterns in the slow cooling zone.

FIG. 9 shows cooling curves for the coil; curve ⑥ is for the cores 6*a* of the edges 6 and curve ⑦ is for the external surfaces. The coil passes through the heat-retaining zone B in time T. If the rod is rapidly cooled immediately after time T, the curves turn as indicated by the arrows a and c. Consequently, the desired cooling is achieved and the targeted quality is obtained in the external surfaces 7. But the densely packed edge 6 is not adequately slow-cooled, which results in higher tensile strength and considerable quality irregularities. If the densely packed coil 5 is conveyed at low speed even after leaving the heat-retaining zone B, the part 6 is slowly cooled, as indicated by the arrow b in FIG. 9, along with the external surfaces, thereby eliminating the quality variation within the coil.

In the rapid cooling zone D, the rod which has been natural cooled on the conveyor 27 is rapidly cooled to a temperature not higher than 550° C. suitable for coil reforming. This rapid cooling is accomplished by means of forced air supplied from an air carrying duct 55 supplied with air from blowers 35. Since the densely packed coil causes an unstable releasing operation on a reforming tub 57, the conveyor speed in the rapid cooling zone D is increased to spread the densely packed coil into a less densely packed coil. A step 22 is provided between the natural-cooling zone C and rapid-cooling zone D for smoothly transferring the coil, while spreading it, onto the conveyor 28 running at a greater speed than the speed of conveyor 27. A step 22 is provided midway of the rapid-cooling zone D for gradually increasing the speed of conveyance of the coil.

The less densely packed coil 3 thus formed is horizontally guided onto a conveyor 29 in the approach zone E.

The length of the individual zones of the cooling apparatus according to this invention are, for example, as follows: zone A, 4 m; heat-retaining zone B, six sections of 6 m each, 36 m; natural-cooling zone C, 6 m; rapid-cooling zone D, two sections, 6 m each, 12 m, making a total of 58 m, plus the approach zone E which is 8 m.

The operation of the apparatus according to this invention will now be described using the slow-cooling process as an example.

After being cooled to the desired temperature by the water-cooling nozzle 11, the hot rolled rod is supplied through the pinch rolls 12 to the laying reel 13 attached thereto to form into a continuous less densely packed coil 9 on the coil receiving roller conveyor 21.

Carried by the roller conveyor section 21, the less densely packed coil enters the heat-retaining cover 31 and over the first step onto first conveyor section 23 where it is formed into a densely packed coil 5 and is cooled according to the desired cooling curve while being conveyed by the inclined roller conveyor sections 23. The individual sections inside the heat-retaining cover 31 are kept at predetermined temperatures.

The densely packed coil 5 entering the heat-retaining cover 31 still retains the heat carried over from the hot rolling process. The temperature of the atmosphere inside the cover 31 is controlled by use of the residual heat released from the rod 5. It is therefore unnecessary to always supply heat from outside. By means of the stirring fans 37 and/or other circulating means, the temerature of the atmosphere inside the heat-retaining cover 31 is maintained uniform, so that the parts of the cross-section of the coil near the external surface parts 7 of the cross-section of the coil 5 are slowly cooled with a uniform temperature. The heat loss compensation device 41, provided between the rollers 24, may be turned on as required to provide compensation for heat loss on both side surfaces *7a* and on the bottom surfaces *7b* of the coil 5 that are particularly likely to be cooled too much.

The densely packed coil 5 moving over the roller conveyor section 23 is loosened as it passes over a step 22 and is dropped onto the following roller conveyor section. The nozles 45 blow coolant against the loosened, falling rings of the coil. The coolant can be the gas constituting the atmosphere within the heat-retaining cover 31 which has been recirculated and cooled to below the original temperature therein. This combination of loosening the coil and blowing coolant thereon effectively removes heat from the cores *6a* of the densely packed edges 6 which are the hottest in the densely packed coil 5. As described hereinbefore, stirring of the atmosphere within the cover 31 plus temperature compensation of the bottom of the coil, if necessary, makes the temperature of the external surface of the densely packed coil 5 uniform. Thus the coil loosening and blowing of coolant make the temperature at different points in the rings making up the densely packed coil 5 substantially uniform, both in the longitudinal direction and cross-section of the coil. This means that the loosening of the coil 5 one or more times with the application of coolant by the nozzles to the cores *6a* of the densely packed edges 6, greatly reduces the temperature difference between the center parts of the cross-section of the coil and the bottom parts. This has been difficult for the prior method as shown in FIG. 2 to achieve. The method thus makes possible the softening of all types of steel as desired, without causing overcooling or leaving the cores of the coil untransformed.

Figure 10:
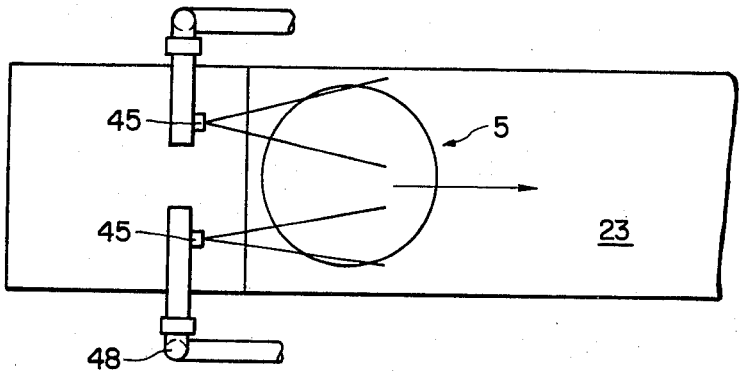
FIG. 10 is a schematic plan view showing how the coolant is applied to a coiled rod according to this invention.

It is preferable to position the coolant nozzles 45 to blow the coolant against the back of the coil, in terms of the direction of travel of the coil. The directing of the nozzles 45 toward the edges 6 of the coil and substantially in the direction of travel of the coil, as schematically shown in FIG. 10, greatly increases the efficiency of the release of heat from the densely packed parts of the coil.

Figure 11:
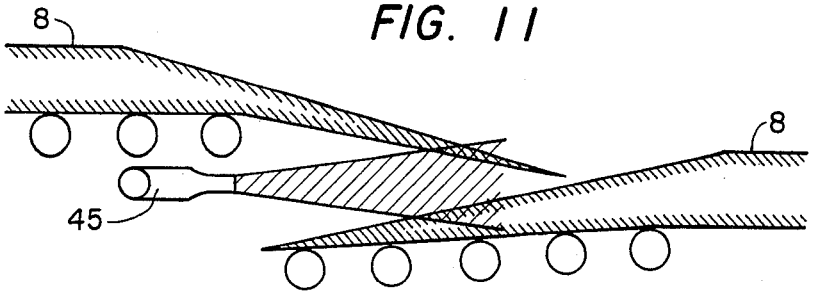
FIG. 11 is a schematic elevational view illustrating the relationship of the effect of the coolant in relation to the discharge angle of the nozzle.

FIG. 11 shows schematically an elevational cross-section through the length of a coil running over a step formed between sections of the roller conveyor. Reference numeral 8 designates the coil 5, which has been shown by continuous lines. As shown, coolant is supplied from means (not shown) to the nozzles 45 at a pressure sufficient to blow the coolant against the loosened, falling coil 8, being directed at the edges 6 thereof. The nozzles 45 are preferably pivotable in the vertical direction through an angle of about 7°, the hatched area in FIG. 11 extending from the nozzles 45 schematically showing the extent of the spray of the coolant.

Figure 12:
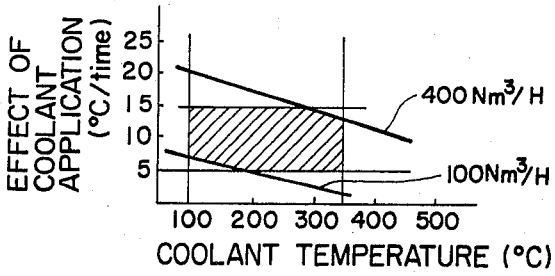
FIG. 12 is a diagram showing the relationship of the effect of the application of coolant, coolant temperature and coolant volume.

The coolant temperature is of course lower than the temperature of the rod, especially the high temperature part thereof. But if the coolant temperature is too low, the external surface parts 7 adjacent to the edges 6 are cooled too much. If the coolant temperature is too high, insufficient heat is released from the cores *6a* of the edges 6. Therefore, the coolant temperature must be kept within an appropriate range. FIG. 12 shows the effect of the coolant blown at a rate of from 100 to 400 $Nm^3/hr.$ on the high temperature parts of a coil of a 5.5 mm diameter rod. The method of this invention seeks to release heat at a rate such that the coil temperature is reduced between 4° and 15° C. at the high temperature cores *6a* of the edges 6 each time the coil passes over a step. As is evident from FIG. 12, the preferable coolant temperature range is between 100° and 350° C. This temperature range is the range of temperatures of the coolant at the tip of the nozzles 45.

Figure 13:
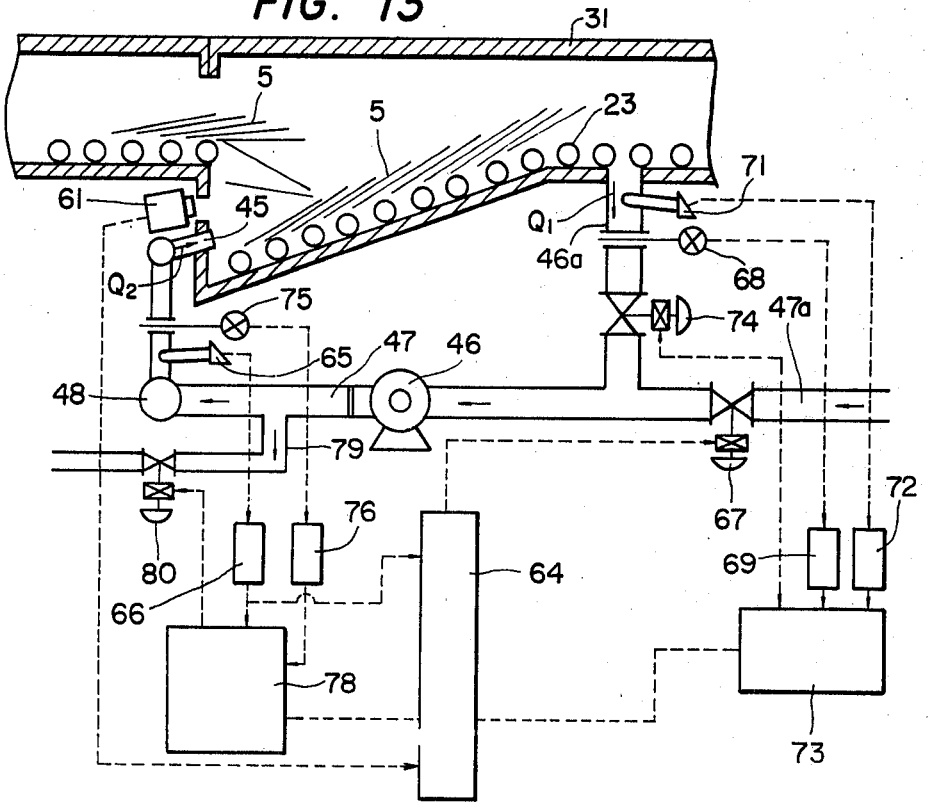
FIG. 13 is a schematic elevational view of a device for controlling the coolant temperature in the cooling apparatus according to this invention.

Thus it is important to regulate the temperature of the coolant blown out of the nozzles 45. To achieve this, a temperature measuring device, such as a non-contact scanning temperature sensor 61 is provided between the nozzles 45 at the step 22, as shown in FIG. 13. The non-contact scanning temperature sensor 61 scans the loosened coil and measures the temperature at different parts of the loosened falling rings of the coil 5 and has peak-hold means to hold the highest temperature sensed. The output thereof is inputted to a temperature controller 64. The nozzles 45 blow the coolant adjusted to the desired temperature against that part of the coil where the peak temperature was detected. In the illustrated embodiment, the coolant is the gaseous atmosphere withdrawn from the exit end of the heat-retaining cover 31. Thus the temperature of the atmosphere must be adjusted to the desired temperature.

The means for adjusting the temperature of the coolant to the desired temperature is constituted by a cold air intake duct *47a* having a cold air mixing valve 67 therein and which joins the duct 47 downstream of the intake 46*a*, and the temperature controller 64. The temperature sensed by the sensor 61 is used to provide an output to the mixing valve to open the valve sufficiently to admit sufficient cold air to reduce the temperature of the atmosphere withdrawn from the cover 31 to the desired temperature as preset in the temperature controller. A thermometer 65 is provided in the ducts behind the header 48 and the output is converted by a temperature converter and supplied to the temperature controller 64 to cause the output to the mixing valve 67 to adjust the valve opening in order to obtain an appropriate temperature.

The nozzles 45 blow the coolant with the temperature thus adjusted against the falling coil 5 where the temperature is higher than the desired level, thereby reducing the temperature variations at different parts of the coil.

As described above, the coolant used in the illustrated embodiment is prepared by mixing the hot atmospheric gas drawn from within the heat-retaining cover 31 and cold air from outside the cover. Because of this, it is necessary to maintain a balance between the quantity $Q_1$ of the gas drawn from the heat-retaining cover 31 and the quantity $Q_2$ of the coolant in order to keep the volume of the atmosphere inside the heat-retaining cover 31 constant.

The means for maintaining this balance is constituted by two flow rate controllers 73 and 78, the flow rate controller being for controlling the quantity $Q_1$ and the flow rate controller 78 for controlling the quantity $Q_2$. In the duct 46*a* is a thermometer 71, the output of which is converted by a temperature converter 72 and supplied to the flow rate controller 73, and a flow meter 68, the output of which is converted by a flow rate converter 69 and supplied to the flow rate controller 73. The temperature and flow rates are utilized to determine the flow rate, and an output from the controller 73 is supplied to a flow rate control valve 74 in the duct 46*a* so that the actual flow rate in the duct does not exceed a predetermined value. The flow rate controller 73 also supplies an output to the flow rate controller 78 which indicates the actual flow rate in the duct 46*a*. As described above, there is a thermometer 65 in the ducts behind the header 48 and the output of this thermometer is also supplied to the flow rate controller 78 through a converter 66, and there is also a flow meter 75 in the ducts behind the header 48, the output of which is supplied to the flow rate controller 78 through the converter 76. The flow rate through the ducts is determined by the flow rate controller 78 and compared with the flow rate in the duct 46*a*, and the output of the controller 78 is used to control the flow rate control valve 80 in the discharge duct 79 branching from the duct 47 so as to balance the quantities $Q_1$ and $Q_2$.

The controllers and their connections can be, for example, a packaged instrument system constituted by analog and digital controllers sold by Yokogawa Electric Works, Ltd. Japan, under the tradename YEW-PACK. Other conventional controllers can, however, be used.

The densely packed coil 5 conveyed by the roller conveyor sections 23 is thus cooled while passing through the successive sections, then leaves the heat-retaining cover with the desired transformation of the metal completed.

The densely packed coil 5 is then naturally cooled on the roller conveyor 27. By increasing the speed of the subsequent conveyor 28, the coil density is decreased. The coil is then rapidly cooled to the desired temperature in the rapid cooling zone D, and collected by a reforming tub 57.

The cooling rate achieved in this embodiment was 0.1° C./sec. But it is also possible to provide uniform cooling at a rate of 0.05° to 1.0° C./sec. and slow cooling at a rate of 0.2° to 1.0° C./sec. by selecting a suitable conveyor speed.

SECOND EMBODIMENT

Figure 14:
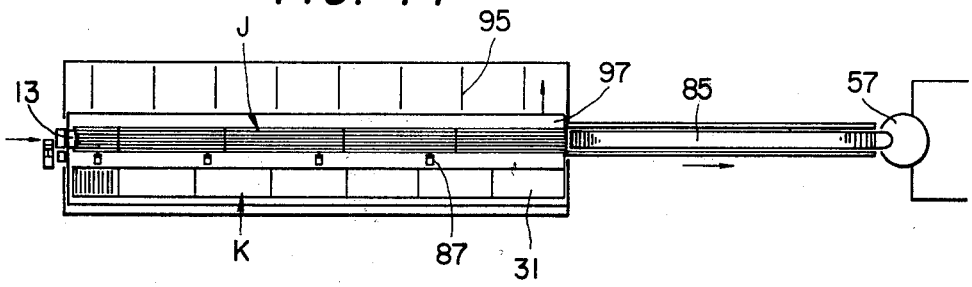
FIG. 14 is a plan view of another embodiment of the cooling apparatus according to this invention.
Figure 16:
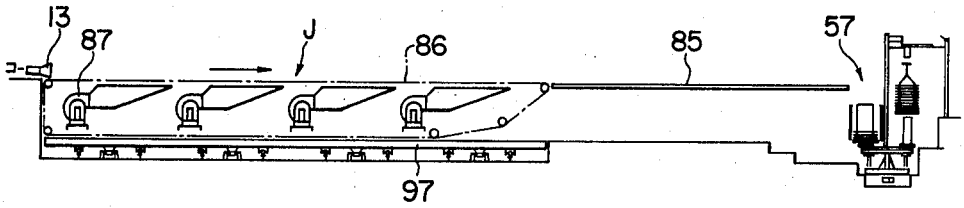
FIG. 16 is a detailed end elevation view of a forced-air cooling line constituting one of the two types of cooling lines in the apparatus shown in FIG. 14.
Figure 15:
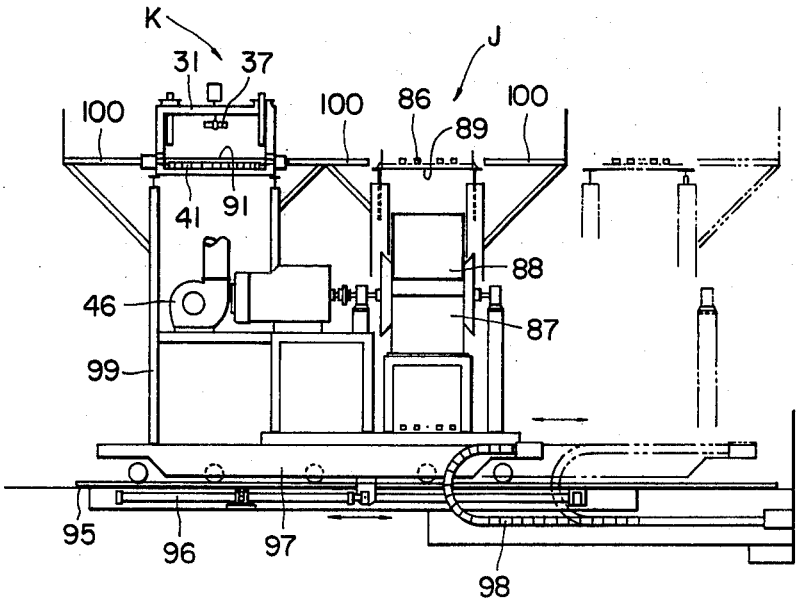
FIG. 15 is an elevational view of the apparatus shown in FIG. 14.

FIGS. 14–16 show a double cooling line in which a forced-air bottom cooling line can be replaced by the slow cooling line according to this invention when slow cooling is desired instead of forced-air cooling.

At the entry end, to the left in FIGS. 14 and 16, is a laying reel 13 that coils and then feeds the hot rolled rod to the subsequent cooling line. The hot rolling mill and water cooling means preceding the laying reel 13 are not shown. The cooling means comprises a forced-air cooling line J and a slow cooling line K, disposed parallel to each other. This double cooling line is followed by a single extension conveyor 85 such as a roller conveyor. A reforming tub 57 to collect the cooled rod is provided at the far end of the conveyor 85.

As shown in FIG. 16, the forced-air cooling line J comprises a transfer conveyor 86, such as a chain conveyor, to convey the coiled rod from the laying reel 13, and a plurality of air blowers 87 provided below the conveyor 86 and spaced therealong in the direction of travel of the coiled rod. As shown in FIGS. 15 and 16, the air from the air blowers 87 is blown through a duct 88 and then through apertures provided in a deck 89 directly under the chain conveyor 86 and against the coiled rod on the conveyor.

The slow cooling line K, shown in FIGS. 14 and 15, is substantially the same as the first embodiment described above, and similar parts are designated by the same reference numerals. The roller conveyor 91 has the various sections fixed, however, rather than being movable to permit changing the inclination thereof.

In this embodiment, the forced-air cooling line J and slowing cool line K, which are positioned substantially parallel to each other, are shiftable laterally to a line between the laying reel 13 and conveyor 85, so that one or the other of the lines can be used as desired. For this purpose, rails 95 are provided which extend substantially perpendicular to the said line. A shift car 97 is mounted on the rails so as to be freely moved back and forth, and a hydraulic piston-cylinder mechanism 96 is connected to the car 97 to move the car. The shift car 97 carries all the equipment that constitutes the forced-air cooling line J and the slow cooling line K. A flexible cable 98 is connected to the car 97 to supply electricity thereto for heaters, motors, etc.

The chain conveyor 86 of the forced-air cooling line J and the roller conveyor 91 of the slow cooling line K are supported at the same level on the shift car 97 on supports 99. A floor 100 is mounted on the outside of both lines and between the two lines. In FIGS. 14–16, the forced-air cooling line J is in position in line with the laying reel 13 and conveyor 85. To shift the slow cooling line K into the aligned position, the hydraulic piston-cylinder 96 mechanism is operated to drive the shift car 97 rightward to the position indicated by the dot-dash lines, thereby aligning the slow cooling line K with the laying reel 13 and conveyor 85. The stroke of the hydraulic piston-cylinder mechanism 96 is preset to correspond to the lateral distance between the two lines.

If a high-carbon steel rod is to be treated, the forced-air cooling line J is placed in the aligned position, so that the coiled hot-rolled rod delivered from the laying reel 13 is conveyed over the chain conveyor 86. During this travel, the air blower 87 blows coolant from below against the coiled rod, thereby rapidly cooling the rod at a rate of 10° to 20° C./sec. The cooled coiled rod is then transferred by the conveyor 85 to the reforming tub 57.

If it is desired to then treat a low-alloy steel wire rod, the hydraulic piston-cylinder mechanism 96 is actuated to drive the shift car 97 to move the forced-air cooling line J aside and place the slow cooling line K into the aligned position.

The means for shifting the cooling lines is not limited to the hydraulic cylinder described, but can be any other appropriate driving means.

The present embodiment thus comprises a plurality of parallel heat-treatment lines which are positioned between the laying reel and the extension conveyor and selectively movable into alignment with the laying reel and the reforming tub depending on the desired operation mode. One of the objects of this invention can thus be achieved by shifting the desired heat-treatment lines perpendicular to the direction of travel of the coiled rod at a point along the path of travel of the coiled rod to provide the desired heat-treatment at that point along the line.

MODIFICATIONS OF COMPONENTS OF THE APPARATUS

The Conveyor

Figure 17:
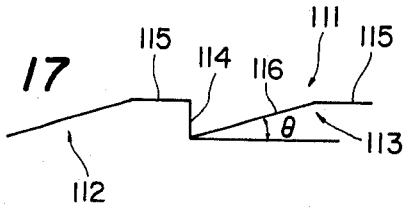
FIG. 17 is a schematic side elevation of an embodiment of the conveyor according to this invention.

FIG. 17 schematically shows an example of a preferred form of the sections 23 of the stepped conveyor. This stepped conveyor section is for a coiled rod having rings 2 with a diameter of 1100 mm. There is provided a step 114 of 200 to 400 mm between a preceding conveyor section 112 and a following conveyor section 113. A 1500 mm long plateau 115, corresponding to wall portion 33 in FIGS. 6 and 7, is provided immediately ahead of the step 114. The angle $\theta$ between the horizontal section 115 and the inclined portion 116 leading to the plateau 115 is not greater than 5 degrees. Though diagrammatically shown as a line for the sake of simplicity, this stepped conveyor comprises, in practice, a series of rollers as shown in FIG. 5.

FIGS. 18(a)–(f) show the results of a coiled rod transfer test carried out on the stepped conveyor as shown in FIG. 17. The testing conditions employed were as follows:

| | |
|---|---|
| Ring diameter of rings | 1100 mm |
| Coil weight | 500 kg/m |
| Conveyor speed | 2.5 m/min. |
| Step height | 400 mm |

In FIGS. 18(a)–(f), reference numeral 45 designates nozzles which blow coolant against the loosened coil, as described in connection with FIGS. 7 and 8.

Figure 18:
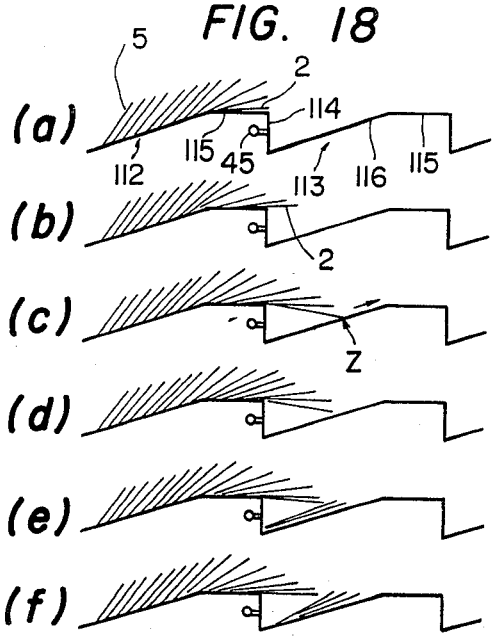
FIGS. 18(*a*)–(*f*) show how the coiled rod travels on the conveyor with a plateau shown in FIG. 17 during a particular period of time.

First, as shown in FIG. 18(a), the first inclined conveyor portion of conveyor section 112 carries a densely packed coil 5 of the hot-rolled rod. When conveyed to the plateau 115, the initial ring 2 lies horizontally as shown in FIG. 18(b). In FIG. 18(c), the foremost end of the ring 2 has been conveyed to where it comes in contact with the inclined portion 116 of the second conveyor 113 at point Z. In FIG. 18(d) the ring 2 fall, one-by-one, onto the inclined portion 116, the upstream ends thereof clearing the plateau 115 of the first conveyor 112 and falling so that they land in an inclined position on inclined portions 116 upstream of point Z. The rings 2 are then moved forward as shown in FIGS. 18(e) and (f).

According to this invention, the point Z at which the foremost end of the ring 2 contacts the inclined portion 116 is caused to be spaced from the step 114 by providing the plateau 115 immediately therebefore. For the ring diameter of 1100 mm, the plateau 115 should preferably be not less than 1500 mm long.

Keeping the contact point Z spaced from the step 114 prevents the collision of the rings 2, which in turn helps transfer the rings 2 in good form to the conveyor 113, as shown in FIGS. 18(e) and (f). This permits optimizing the distance to the falling rings 2 from the nozzles 45, and optimizing the position and direction of the nozzles 45. As a consequence, the rod rings can be cooled under the optimum conditions to give them a uniform temperature therethrough.

On the contrary, FIGS. 19(a)–(f) show the results of a test made on a stepped conveyor 121 having no plateau 115. The test was carried out under the same conditions as described above. In this stepped conveyor 121, the steps were spaced at intervals of 4.5 m and the angle of inclination of the respective sections was 5 degrees.

Figure 19:
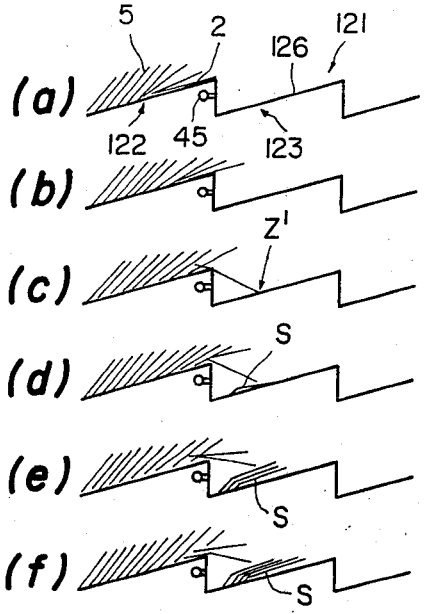
FIGS. 19(*a*)–(*f*) show how the coiled rod travels on a plateauless conveyor.

The rings 2 conveyed along the inclined conveyor section 122 move forward as shown in FIGS. 19(a) and (b). The foremost end of the leading ring 2 comes in contact with the inclined surface 126 of the next conveyor section 121 at point Z' which is closer to the step than point Z, as shown in FIG. 19(c). Consequently, the rings 2 will develop a bend S as a result of the collision with the inclined surface 126 of the conveyor section 121 or due to the combined effect of the step and the succeeding rings, as shown in FIGS. 19(c)–(f). The bends developed in successive rings as shown in FIGS. 19(e) and (f) ultimately deforms the entire coil. When this bend S develops, the distance, position and direction of the rings relative to the coolant nozzle 45 becomes inappropriate. As a consequence, it becomes difficult to attain a uniform temperature throughout the entire coil 5, and, therefore, to achieve the targeted quality. Moreover, collision of the coil with succeeding rollers resulting from the development of the bend S interrupts the smooth operation of the line and impairs productivity.

FIGS. 20–24 show modified embodiments of the conveyor.

Figure 20:
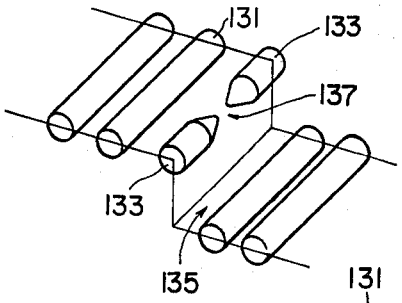
FIG. 20 is a schematic perspective view showing a roller conveyor having a roller for guiding the rear ends and sustaining both edges of the coil over the step.
Figure 21:
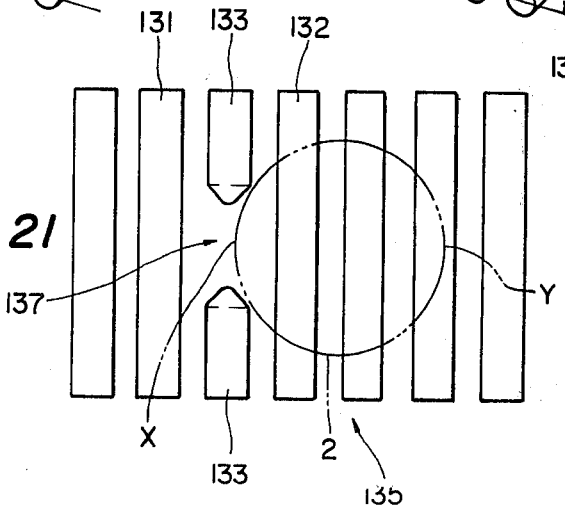
FIG. 21 is a schematic plan view of the conveyor of FIG. 20.

As shown in FIGS. 20 and 21 the roller 133 of a conveyor section 131 which forms the upper edge of a step 135 between the conveyor sections 131 and 132 is divided into two parts, each of which is supported in cantilever bearings at the outer end and being substantially conically pointed at the inner end. The opposed conical ends are spaced and together form a guide opening 137 conforming generally with the curvature of the ring 2 indicated by a double-dot-dash line in FIG. 21.

As shown in FIG. 21, the ring 2 is separated from the succeeding rings so as to fall onto the next conveyor 132 as the rearmost end X passes through the guide opening 137. Since the roller 133 at the downstream end of the first conveyor 131 is at the end of the substantially horizontal portion, both the foremost end Y and the rearmost end X of the ring 2 fall onto the following conveyor 132 substantially at the same speed. Therefore, the separated, falling ring lands gently on the following conveyor 132. Thus the ring 2 falling from the step 135 maintains the most desirable form, avoiding quality deterioration, thus making it easier to attain uniform temperature distribution throughout the entire coiled rod, and assuring uniform metal structure and mechanical properties.

In the embodiment shown in FIGS. 20 and 21, the guide opening 137 is formed by a single pair of opposed roller parts, but further pairs of roller parts can be used.

Figure 22:
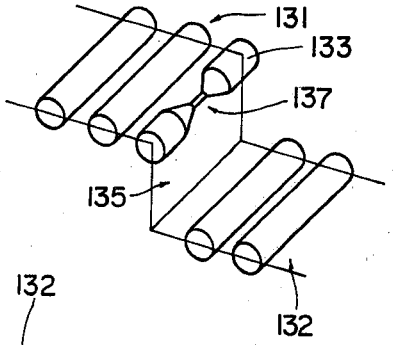
FIG. 22 is a perspective view showing another embodiment of the guide roller.

FIG. 22 shows a modification of the roller 133 to form the guide opening 137. In addition to guiding the rings in the same way and achieving the same effect as the embodiment of FIGS. 20 and 21, the modification of FIG. 22 has the advantage of preventing the adverse effect of heat on the roller 133 because the roller 133 is shaped as a single roller supported at both ends. In FIG. 22, reference numeral 137 denotes the guide opening the curvature of which is larger than the curvature of the ring 2. The guide opening 137 is formed by providing a recess around the roller 133.

As described above, the guide opening 137, having a shape substantially conforming with the curvature of the rings, is provided at the upper edge of the step between a preceding conveyor section and a following conveyor section.

Accordingly, the separated rings pass smoothly over the step 22 onto the following conveyor section and the leading end of the coil does not plunge into the gap between the rollers thereof, thereby assuring stable coil transportation.

Figure 23:
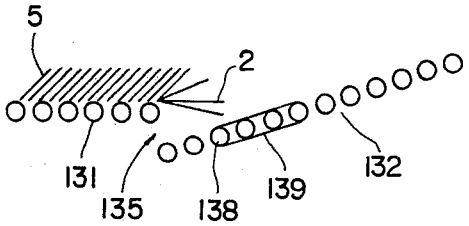
FIG. 23 is a schematic side elevational view of yet another embodiment of the conveyor according to this invention.
Figure 24:
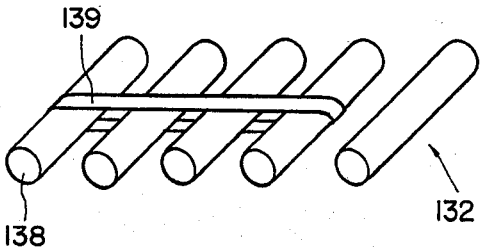
FIG. 24 is a perspective view showing a principal part of the conveyor of FIG. 23.

FIGS. 23 and 24 show another embodiment of a rod check plate corresponding to the check plate 25 described previously. An endless belt or chain 139 is passed around a plurality of rollers 138 at the point at which the leading end of the ring falling from the step 135 strikes the inclined section. This endless belt or chain 139 prevents the separated falling ring 2 from plunging between the rollers 138.

Heat Loss Compensation Device

The following describes modifications of the heat loss compensation device corresponding to the device 41 described previously, for achieving a uniform temperature distribution throughout the entire coil by locally heating the densely packed coil 5 in the heat-retaining cover 31.

Figure 25:
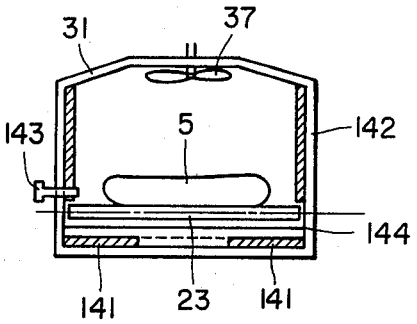
FIG. 25 is a sectional front view of a heat-retaining cover provided with a heat supplying device.
Figure 26:
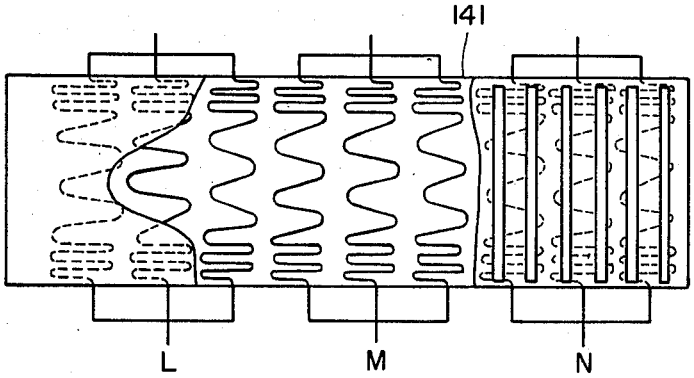
FIG. 26 is a plan view, partially broken away, showing an embodiment of a bottom heater.

FIG. 25 is a cross-sectional view showing a densely packed coil 5 being carried by a conveyor section 23 through the heat-retaining cover 31. FIG. 26 is a plan view showing the relationship between the conveyor section 23 and a heater 141 provided thereunder. Sinuous resistance ribbon heaters 142 are provided on the inside of the opposite side walls of the heat retaining cover 31 and a sinuous resistance ribbon heater 141 is provided beneath the conveyor section, the number of convolutions of the ribbon heater 141 which are beneath the side portions of the coil 5, which require greater heat adjustment than the center, being greater than the number of convolutions under the center. A non-contact temperature sensor 143 is provided in the side wall of the cover 31 and is directed toward the side of the coil 5. Further, an electrically insulating plate 144 may be provided above the heater 141 to prevent the grounding thereof. Preferably the plate is made of an electrically insulating material having a high heat transfer rate, such as fused silica.

Figure 27:
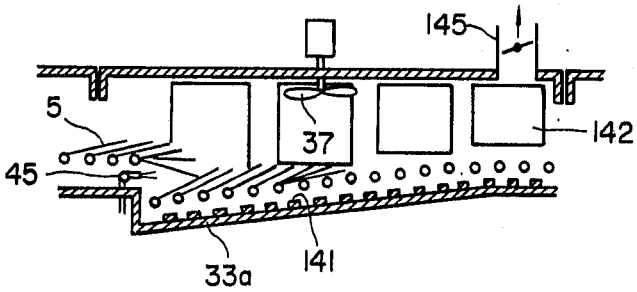
FIG. 27 is a sectional side elevation view of the cover of FIG. 25.

As seen in FIG. 27, the side heaters 142 are divided into several sections that are disposed at regular intervals along the cover 31. The bottom heater 141 is located between the rollers making up the conveyor and the housing 33*a*. In addition, a heat outlet 145 can be provided in the top of the heat-retaining cover 31 in order to permit the temperature therein to be reduced by allowing escape of hot gas.

As discussed previously, the bearings for the rollers of the conveyor section 23 are disposed outside the heat-retaining cover 31, and accordingly heat from the coil is likely to pass through the rollers and escape through the portions in the bearings. This tendency is especially pronounced at both sides of the bottom of the densely packed coil 5 which comes in contact with the rollers, and these portions are therefore likely to become cooled too much. The heaters 141 and 142 supply heat to compensate for this loss. This compensation need not be provided at all times, but only when necessary, or when the temperature of the bottom of the coil falls below the target range. The bottom heating means is divided into a plurality of heating blocks, designated L, M and N in FIG. 26, each comprising a plurality of heaters 141. The individual blocks can be independently controlled so as to provide heating only where required. The side heaters 142 can also be divided into several groups in the direction of movement of the conveyor, thereby permitting similar selective heating.

In practice, it is preferable to provide an automatic control system which includes temperature sensing devices, such as the device 143 in FIG. 25, capable of continuously measuring the temperature of such parts of the coil 5 which are expected to become cooler than others. This sensor is connected to the operating unit for the bottom heaters 141 and side heaters 142 through a suitable control unit, describing hereinafter. When a temperature lower than the target level is detected, electricity is supplied to the corresponding heating block to provide selective, quick heating for the low temperature part. Both heating temperature and time can be controlled exactly.

Figure 28:
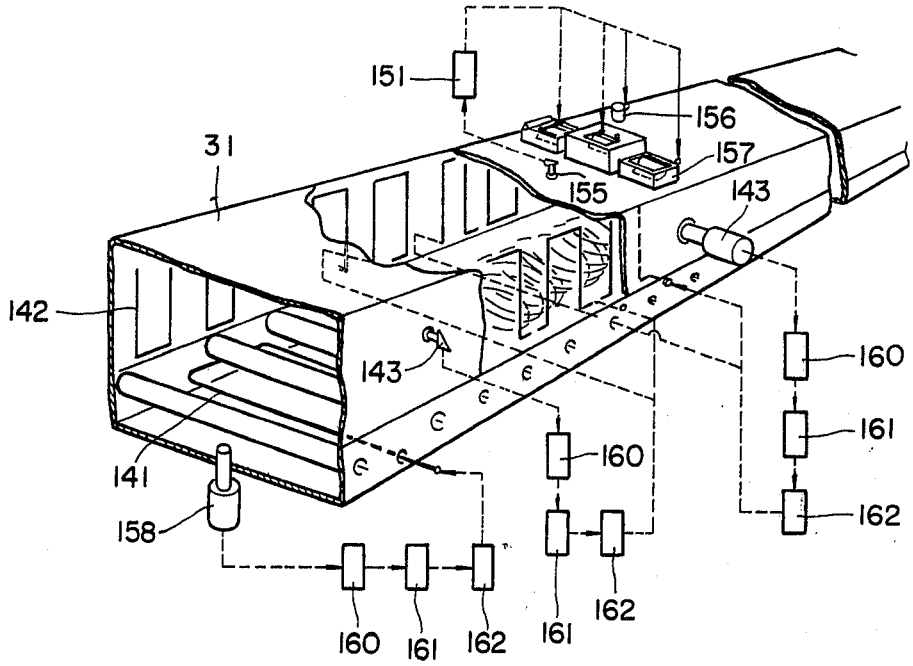
FIG. 28 is a partly broken away perspective and a partly schematic view of the heat retaining cover with ambient temperature control devices and the heat supplying device therein.

Controls for Heat-Retaining Cover, Atmosphere Temperature and Heat Loss Compensation Devices As shown in FIG. 28, the means for controlling the temperature of the atmosphere within the cover 31 comprises a plurality of control system each having a thermometer 155, the output of which is connected to a temperature controller 151, and an intake suction fan 156 and an exhaust damper 157 in the exhaust outlet 145 in the cover 31. The desired ambient temperature within the cover 31 is preset in the controllers 151 of the respective systems depending on the steel being treated, and the temperatures descending stepwise in the direction the coil is conveyed through the cover 31. When the temperature measured by the thermometer 155 in a given system exceeds the preset temperature, the suction fan 156 is driven to introduce cold air into the cover, the exhaust damper also being opened to exhaust hot atmospheric gas. When the temperature within the cover is at the desired temperature, or lower, the suction fan is stopped and the dampers closed.

The means for compensating for the heat loss at the sides of the bottom portion of the coil 5 comprises a similar plurality of control system each having a temperature sensing device 143 opposed to the sides of the coil 5 as it moves along the conveyor section, the output of the device 143 being connected to a temperature controller 161 through a converter 160. The temperature converters are preset to the desired coil temperatures along the path of the conveyor. Each temperature controller in turn is connected to a power supply 162 which is connected to the side heaters 142. When the temperature of the sides of the bottom of the coil falls too low, indicating that the side portions of the bottom of the coil are losing too much heat, the controller 161 turns the power supply on. Similarly, the means for compensating for the heat loss at the bottom of the coil comprises a plurality of system each having a temperature sensing device 158 in the bottom of the housing 31 and connected to temperature controller 161 through a converter 160, the temperature controller being connected to a power supply for the heaters 141. The operation of these systems is the same as the systems for compensating for the heat loss from the sides of the coil.

avoid this risk, the heat-retaining cover 31 has a damper 166 in the top thereof. When the pressure of the gas in the heat-retaining cover 31 rises, the damper 166 is opened to release the gas into the surrounding atmosphere. A pressure detector 167 is connected to the heat-retaining cover 31, and the signal emitted therefrom is inputted to a control gauge 168 preset for the desired pressure within the cover 31. The operating signal from the control gauge 168 opens and closes the damper 166 to maintain the atmospheric pressure inside the heat-retaining cover 31 at the desired level.

Examples of the Cooling of Hot-Rolled Rods

A series of tests were carried out for slow cooling of hot-rolled rods using the apparatus shown in FIG. 5. Table 1 lists the testing conditions and results. Table 2 shows the chemical compositions of the steels subjected to the tests.

TABLE 1

| | Test No. | Rod Steel Grade | Rod Diameter (mm) | Coil Density (kg/m) | Conveyor Speed (m/min) | Coil Loosening (times) | Coolant Temp. (°C.) | Loosening Step Height (mm) | Stirring | Heat Compensation | Ambient Temp. (°C.) |
|---|---|---|---|---|---|---|---|---|---|---|---|
| A | 1 | SCM435 | 5.5 | 227 | 3 | 6 | 350 | 350 | Fan | Elec. heater | 700–650 |
| A | 2 | SCM435 | 5.5 | 227 | 3 | 6 | 350 | 350 | Fan | — | 700–630 |
| A | 3 | SCM435 | 5.5 | 227 | 3 | 3 | 350 | 350 | Fan | Elec. heater | 700–640 |
| B | 4 | SCM435 | 5.5 | 227 | 3 | 0 | — | — | — | — | 650–250 |
| A | 5 | SCM435 | 13.0 | 315 | 3 | 6 | 300 | 400 | Fan | Elec. heater | 700–650 |
| B | 6 | SCM435 | 13.0 | 315 | 3 | 0 | — | — | — | — | 650–270 |
| A | 7 | S45C | 9.0 | 59 | 18 | 6 | 250 | 200 | Fan | Elec. heater | 450–400 |
| B | 8 | S45C | 9.0 | 59 | 18 | 0 | — | — | — | — | 450–250 |
| A | 9 | S45C | 13.0 | 52 | 18 | 6 | 200 | 250 | Fan | Elec. heater | 450–400 |
| B | 10 | S45C | 13.0 | 52 | 18 | 0 | — | — | — | — | 450–250 |

| | Test No. | Rod Temp. (°C.) At Cover Inlet | Rod Temp. (°C.) At Cover Outlet | Max. Temp. Deviation (°C.) | Tensile Strength (kg/mm²) |
|---|---|---|---|---|---|
| A | 1 | 740–710 | 680–720 | 40 | 68–75 |
| A | 2 | 740–710 | 640–720 | 80 | 68–79 |
| A | 3 | 740–710 | 680–740 | 60 | 68–79 |
| B | 4 | 740–710 | 590–710 | 120 | 67–115 |
| A | 5 | 740–710 | 680–710 | 30 | 66–76 |
| B | 6 | 740–710 | 600–700 | 100 | 70–110 |
| A | 7 | 740–710 | 620–680 | 60 | 68–72 |
| B | 8 | 740–710 | 610–720 | 110 | 67–77 |
| A | 9 | 740–710 | 620–670 | 50 | 68–72 |
| B | 10 | 740–710 | 620–720 | 100 | 66–76 |

Note:
A = Method according to this invention.
B = conventional method.
Maximum temperature deviation means deviation in each portion of cross-section of the rod.

Coolant Temperature Control Device

Figure 29:
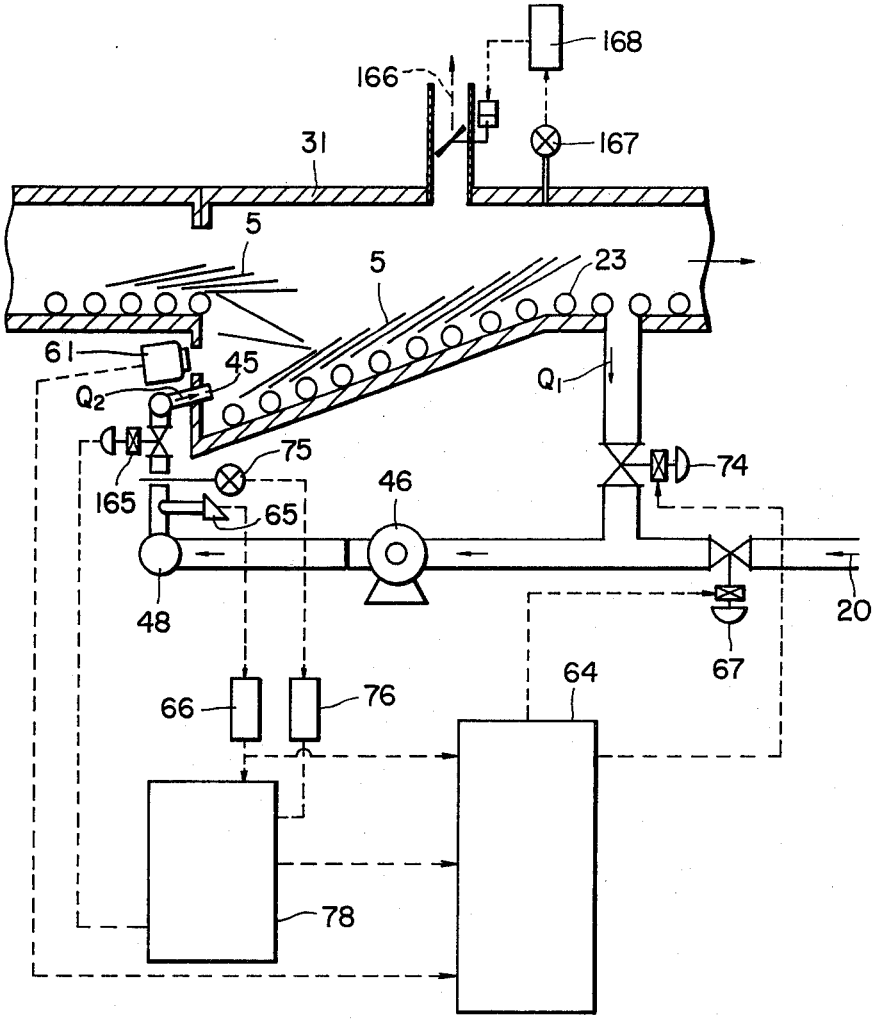
FIG. 29 is a schematic sectional view of another embodiment of the coolant temperature control device.

FIG. 29 shows schematically a modified coolant temperature control device. Since this device is similar to the one shown in FIG. 13, similar parts are designated by the same reference numerals.

The device of FIG. 29 is designed to blow all of the coolant gas into the heat-retaining cover 31 instead of diverting a portion thereof. It therefore differs from the device of FIG. 13, in which a flow rate control valve 165 is provided immediately ahead of the nozzle 45 to regulate the quantity of the coolant gas. Because excess coolant gas is not discharged through a branch pipe as in the device of FIG. 13, there is the possibility that the pressure of the gas constituting the atmosphere in the heat-retaining cover 31 will become extremely high. To

TABLE 2

| Steel Grade | Chemical Composition (%) C | Si | Mn | P | S | Cr | Mo |
|---|---|---|---|---|---|---|---|
| SCM435 | 0.34 | 0.24 | 0.65 | 0.018 | 0.013 | 1.03 | 0.22 |
| S45C | 0.45 | 0.27 | 0.66 | 0.018 | 0.015 | — | — |

As is evident from Table 1, tests Nos. 1 through 6 carried out the heat treatment by slow cooling at a rate of between 0.05° and 0.2° C./sec., for the purpose of eliminating low-temperature annealing. Of these tests, Nos. 4 and 6 were carried out according to the conventional method. Tests Nos. 7 to 10 carried out slow cooling at a rate of from above 0.2° to 1.0° C./sec., to soften the rod to improve drawability. In this group, tests Nos. 8 and 10 were carried out according to the conventional method.

Figure 30:
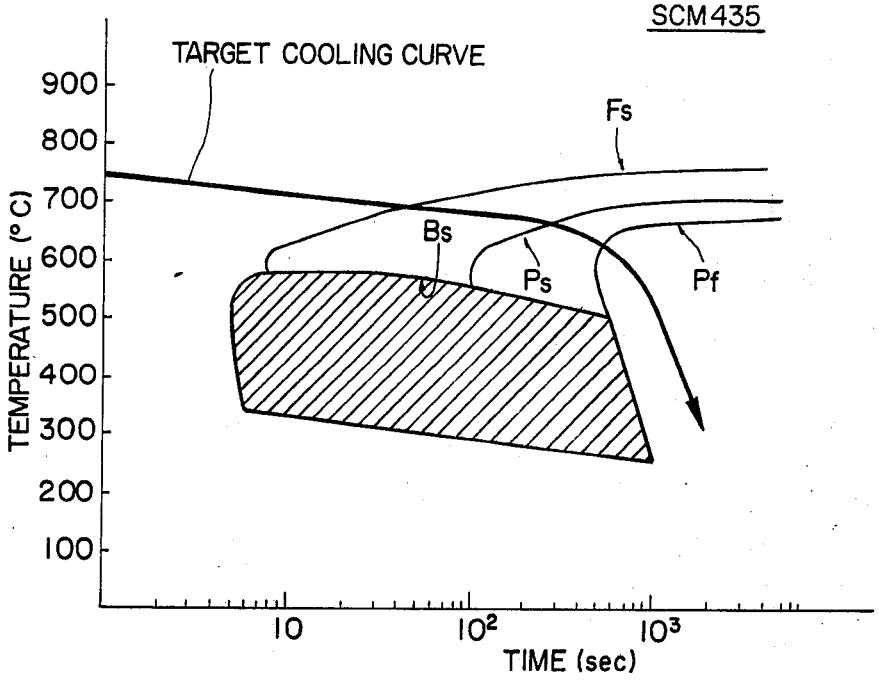
FIG. 30 is a diagram of a cooling curve for a coiled rod coiled by the apparatus of this invention.
Figure 31:
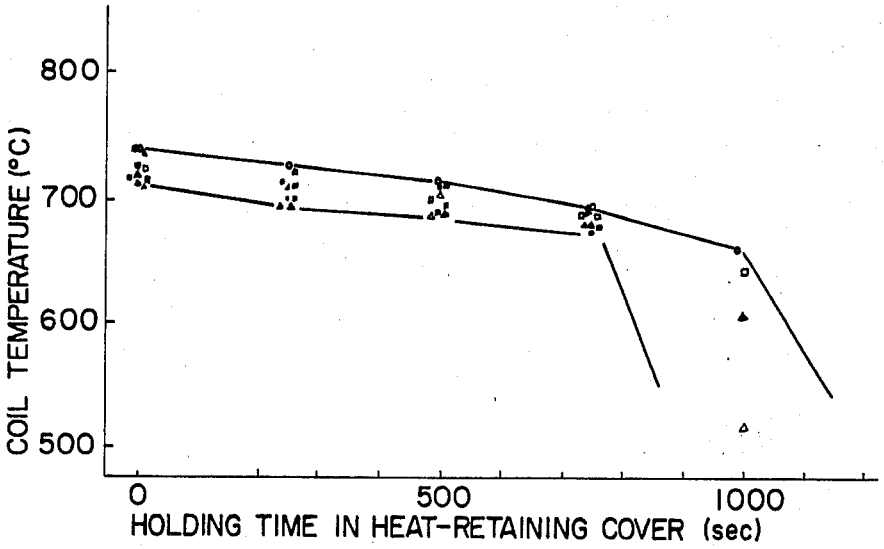
FIG. 31 is a diagram of the temperature sequence under testing during slow cooling of the densely packed coil by this invention.

In the tests of the apparatus according to this invention, cooling was effected according to the cooling curves suitable for achieving the object of treatment. The cooling in tests Nos. 1 and 3, for example, followed the cooling curve shown in FIG. 30, under the testing conditions listed in Table 1. As is evident from Table 1, the temperature deviations between the external surface parts 7, including parts *7a* and *7b*, and the densely packed part 6, including parts *6a*, of the densely packed coil were greatly reduced in the tests Nos. 1, 2, 3, 5, 7 and 9, as compared with the conventional method carried out in tests Nos. 4, 6, 8 and 10. The temperature deviations in test No. 1 were shown in FIG. 31, which, when compared with FIG. 2, evidences the extent of minimization of the deviations. As a result of this reduction in temperature deviations, tensile strength range in the rod was greatly decreased and the steel of the rod was adequately softened.

What is claimed is:

1. An apparatus for slow cooling a rod delivered from a hot rolling mill while transferring it, comprising:

a laying reel for forming the rod into successive rings;

a conveyor means having a coil receiving portion below the reel for receiving the rings and means for forming them into a packed coil having a plurality of overlapped rings with the centers of the rings offset and the edges of the cross-section of the coil being very densely packed together;

said conveyor having at least one step therein with the section of the conveyor downstream of the step lower than the section of the conveyor upstream of the step, said step being sufficiently high for passing the rings of the coil through a vertical drop for loosening the coil when it is conveyed over the step by making an opening between the preceding rings and the succeeding rings, and causing the succeeding rings to again come in contact with the preceding rings;

at least one enclosure for enclosing at least the step and the sections of said conveyor between which said step is located, and having a gaseous heat transfer medium therein;

at least one stirring fan attached to the ceiling of said enclosure for circulating the gaseous medium in said enclosure in order to maintain the gaseous medium at a substantially uniform temperature and circulating the gaseous medium over the exposed surfaces at the rings of the coil for removing heat from the rings by convection;

means for discharging the gaseous medium from the enclosure and introducing gas from outside which is at a temperature lower than the temperature of the gaseous medium in said enclosure and being in an amount sufficient for, together with the circulation of the gaseous medium, maintaining the gaseous medium at a substantially uniform temperature which is lower than the temperature of the coil at the inlet end of said enclosure for progressively reducing the temperature of the coil in the direction of movement of said conveyor.

2. An apparatus as claimed in claim 1 which further comprises a heat supplying means in said enclosure for supplying heat onto both edges and bottom of said coil on the conveyor.

3. An apparatus as claimed in claim 1 in which said conveyor further comprises a natural cooling conveyor portion subsequent to said enclosure and which is open to the atmosphere for permitting slight cooling of the coil in the open atmosphere, and a forced air cooling conveyor portion subsequent to said natural cooling conveyor portion.

4. An apparatus as claimed in claim 3 in which said natural cooling conveyor further comprises a means for forming the densely packed coil into a less densely packed coil and having an upstream conveyor part for conveying the densely packed coil and a downstream conveyor part subsequent to said upstream conveyor part and having the upstream end lower than the downstream end of said upstream conveyor part to form a step between said parts, and said downstream conveyor part being a higher speed conveyor part than said upstream conveyor part, whereby the densely packed coil is formed into a less densely packed coil when it is conveyed over said step from said upstream conveyor part to said downstream conveyor part.

5. An apparatus for slow cooling a rod delivered from a hot rolling mill while transferring it, comprising:

a laying reel for forming the rod into successive rings;

a conveyor means having a coil receiving portion below the reel for receiving the rings and means for forming them into a packed coil having a plurality of overlapped rings with the centers of the rings offset and the edges of the cross-section of the coil having very densely packed together;

said conveyor having at least one step therein with the section of the conveyor downstream of the step lower that the section of the conveyor upstream of the step, said step being sufficiently high for passing the rings of the coil through a vertical drop for loosening the coil when it is conveyed over the step by making an opening between the preceding rings and the succeeding rings, and causing the succeeding rings to again come in contact with the preceding rings;

at least one enclosure for enclosing at least the step and the sections of said conveyor between which said step is located, and having a gaseous heat transfer medium therein;

at least one stirring fan attached to the ceiling of said enclosure for circulating the gaseous medium in said enclosure in order to maintain the gaseous medium at a substantially uniform temperature and circulating the gaseous medium over the exposed surfaces of the rings of the coil for removing heat from the rings by convection;

means for discharging the gaseous medium from the enclosure; nozzle means in said enclosure in the vertical portion of said step and directed in the direction of the movement of the conveyor toward the portions of the rings loosened from the densely packed edges of the coil; and means connected to said nozzle means for supplying coolant to said nozzle means at a pressure for blowing the coolant from the vertical portion of the step against said portions of the rings loosened from the coil as the rings of the coil are conveyed over the step, said coolant being at a temperature lower than the temperature of the gaseous medium in said enclosure and being in an amount sufficient for, together with the circulation of the gaseous medium, maintaining the gaseous medium at a substantially uniform temperature which is lower than the temperature of the coil at the inlet end of said enclosure for progressively reducing the temperature of the coil in the direction of movement of said conveyor.

6. An apparatus as claimed in claim 5 in which said means for discharging gas from within said enclosure comprises, a suction duct means having a blower therein and having an intake side connected to said enclosure and a discharge side connected to said nozzles, and further comprising and outside atmosphere intake duct connected to said suction duct on the intake side of said blower for drawing in outside atmosphere for cooling the gas from within said enclosure to form the coolant, and control means connected in said duct for controlling the amount of outside atmosphere drawn in and the amount of gas blown back into said enclosure at said step through said nozzles.

7. An apparatus as claimed in claim 5 in which the enclosure has a horizontal top and the section of said conveyor downstream of said step has an upward inclination in the direction of conveyance to the level of the part of the conveyor at the upstream side of said step.

8. An apparatus as claimed in claim 7 in which said conveyor further has a horizontal plateau at the downstream end of the upwardly inclined section.

9. An apparatus as claimed in claim 7 in which said inclined upstream end of said downstream section is a roller conveyor and has means between the rollers for preventing the rings passing over said step from plunging into spaces between the adjacent rollers.

10. An apparatus as claimed in claim 5 in which said coil receiving portion, said conveyor means including said step, said enclosure, said stirring fan, said gas discharging means, said nozzle means and said coolant supplying means together constitute a slow cooling line, and said apparatus further comprises an extension conveyor means subsequent to said slow cooling line, a forced air cooling line, mounting means on which said slow cooling line and said forced air cooling line are mounted parallel to each other and means for shifting said cooling lines laterally to the direction of movement of said conveyor for moving the slow cooling line out of the path between said laying reel and said extension conveyor and moving said forced air cooling line into the path for substituting said forced air cooling line for said slow cooling line and for moving said forced air cooling line out of the path and moving said slow cooling line into the path for substituting the slow cooling line for the forced air cooling line.

* * * * *